United States Patent [19]

Dresler et al.

[11] 4,388,051

[45] Jun. 14, 1983

[54] PISTON PUMP WITH INTAKE VALVE

[75] Inventors: Helmut Dresler, Trostberg; Ernst Turnwald, Altenmarkt, both of Fed. Rep. of Germany

[73] Assignee: Linde Aktiengesellschaft, Wiesbaden, Fed. Rep. of Germany

[21] Appl. No.: 233,169

[22] Filed: Feb. 10, 1981

[30] Foreign Application Priority Data

Feb. 15, 1980 [DE] Fed. Rep. of Germany ..... 3005608

[51] Int. Cl.[3] ..... F04B 7/00; F04B 15/08

[52] U.S. Cl. ..... 417/505; 417/901

[58] Field of Search ..... 417/505, 561, 569, 570, 417/901

[56] References Cited

U.S. PATENT DOCUMENTS

| | | | |
|---|---|---|---|
| 2,765,747 | 10/1956 | Aumick | 417/505 |
| 3,299,828 | 1/1967 | Josephian | 417/901 |
| 3,427,988 | 2/1969 | Redman et al. | 417/569 |
| 3,485,441 | 12/1969 | Eaton, Jr. | 417/505 |

OTHER PUBLICATIONS

Linde-Berichte (Linde reports) 36, 1979, pp. 15-22 (no translation).

*Primary Examiner*—John J. Camby

*Attorney, Agent, or Firm*—Karl F. Ross; Herbert Dubno

[57] ABSTRACT

A piston pump having an intake valve whose valve member is approached by the pump piston. The piston magnetically attracts the valve member during the intake stroke to overcome the force of the spring biasing the valve member into its closed position.

5 Claims, 2 Drawing Figures

1
2
3
4
5
6
7
8
9
10
11
12
13
14
15
16
30
31
32
33
34
35
36
37
38
A

PISTON PUMP WITH INTAKE VALVE

FIELD OF THE INVENTION

The present invention relates to a piston pump and, more particularly, to a piston pump of the type in which an intake valve is provided in axial alignment with the pumping piston.

BACKGROUND OF THE INVENTION

In a piston pump of the aforedescribed type, e.g. for the displacement of cryogenic fluids such as deeply cooled liquefied gas and for other purposes, it is known to provide a reciprocating piston which is axially shifted in a cylinder forming a pumping chamber, to draw fluid into this chamber through an intake opening on the intake stroke, and displace this fluid past a pressure valve through the outlet during the discharge stroke.

A pump of this type is described in *Linde-Berichte aus Technik und Wissenschaft,* 36/1975, pages 15 to 22.

The intake port is axially aligned with the piston and is provided with a valve member in the form of a plate which seats at this port under the force of a spring so that the intake port is blocked during the discharge stroke of the piston and the intake stroke of the piston must initially overcome the spring force and induce the intake valve to open before fluid will be drawn into the pumping chamber.

The function of the spring is to ensure rapid closure of the intake valve so that reversal of the direction of piston movement from the intake to the discharge stroke will not permit discharge of the fluid from the chamber through the intake port. Backflow of fluid from the pumping chamber through the input port and a corresponding reduction in the pumping efficiency is avoided in this manner.

However, since fluid pressure upon the valve member must overcome the spring force during the intake stroke of the piston, opening pressure losses are encountered and intake of fluid is delayed.

It has been sought to overcome this disadvantage by increase in the head of the fluid upstream of the intake port so that the force of the fluid outside the pumping chamber acts upon the valve member in a direction opposite the spring force and thereby contributes to a more rapid opening of the intake valve.

However, increasing the fluid head is difficult in many cases and frequently can only be effected at high cost, if at all, because the practical method of obtaining an increased fluid head on the intake side is to raise the level of the liquid delivered to the intake port.

Frequently it is not possible to elevate the reservoir or vessel containing the liquid to be pumped because of space considerations and in many instances it is neither possible nor practical to provide the vessel at such heights that even when it is close to empty a sufficient force is provided to balance the spring force, or to lower the pumping chamber to the point that the desired head is provided.

OBJECTS OF THE INVENTION

It is the principal object of the present invention, therefore, to improve upon pumps of the aforedescribed type by reducing the intake pressure losses which result from the spring-biased intake valve.

Another object of the invention is to provide an improved piston pump, especially for cryogenic fluids not limited thereto, whereby disadvantages of prior art systems are obviated.

SUMMARY OF THE INVENTION

These objects and others which will become apparent hereinafter are attained, in accordance with the present invention, in a piston pump having a cylinder forming a pumping chamber, a piston axially reciprocatable in this chamber with an intake stroke in one direction and a discharge stroke in the opposite direction, an intake port provided with an intake valve member which is proximal to the piston member at the beginning of the intake stroke, a spring biasing the valve member into its closed position, and a pressure discharge valve which communicates with the valve member.

According to the invention, means is provided whereby a magnetic force is applied between the piston member and the valve member at least during the inception of the intake stroke in a direction opposite the effect of the spring force, thereby momentarily attracting the valve member into its open position for at least partial compensation of the spring force during or prior to the inception of the intake stroke.

While either of these members (valve member and piston member) may be formed as the permanent magnet in accordance with the invention, while the other is a magnetically attractable element, we have found it to be advantageous to form the piston member as or with a permanent magnet.

In the system of this invention three forces act upon the valve member or plate:

The first force is the resultant force of the pressure differential across the intake valve. The second force is the spring force and the third force is the magnetic force which is effective over the short space between the limiting position of the piston member before commencement of the intake stroke and the valve plate juxtaposed therewith.

The first or pressure force is a function of the level of the liquid on the supply side of the intake valve and the direction of movement of the piston. The magnetic force decreases with increasing spacing of the piston from the valve plate and this at its maximum at the commencement of the intake stroke.

It is thus possible to control the opening movement of the valve plate not only as a function of the pressure of the liquid to be displaced but also by varying the magnetic attraction force between the valve plate and the piston and it is possible utilizing the magnetic attraction to reduce the lag between the beginning of the intake stroke and the opening of the intake valve practically to zero, thereby increasing the displacement capacity of the pump and enabling the liquid level on the feed side of the intake valve to be reduced since at least a portion of the pressure head can be replaced by the magnetic force.

Since the magnetic force applied to the valve plate falls off sharply with increasing distance between the piston and the valve member and is at a minimum at the instant at which the stroke reversal of the piston takes place, to the discharge stroke, the magnetic force does not affect the speed at which the spring closes the valve at the beginning of the pressure or discharge stroke.

It has been found to be advantageous, when the piston is formed as a permanent magnet to provide the side of the valve plate turned toward the piston with a covering or layer of a ferromagnetic material.

In a preferred embodiment of the invention, the magnetic force between the valve plate and the piston, at the minimum spacing between them, is greater than the spring force tending to bias the intake valve into its closed position. This of course can be achieved by properly selecting either the magnetic field strength or the spring constant, or both.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figures 1, 2:
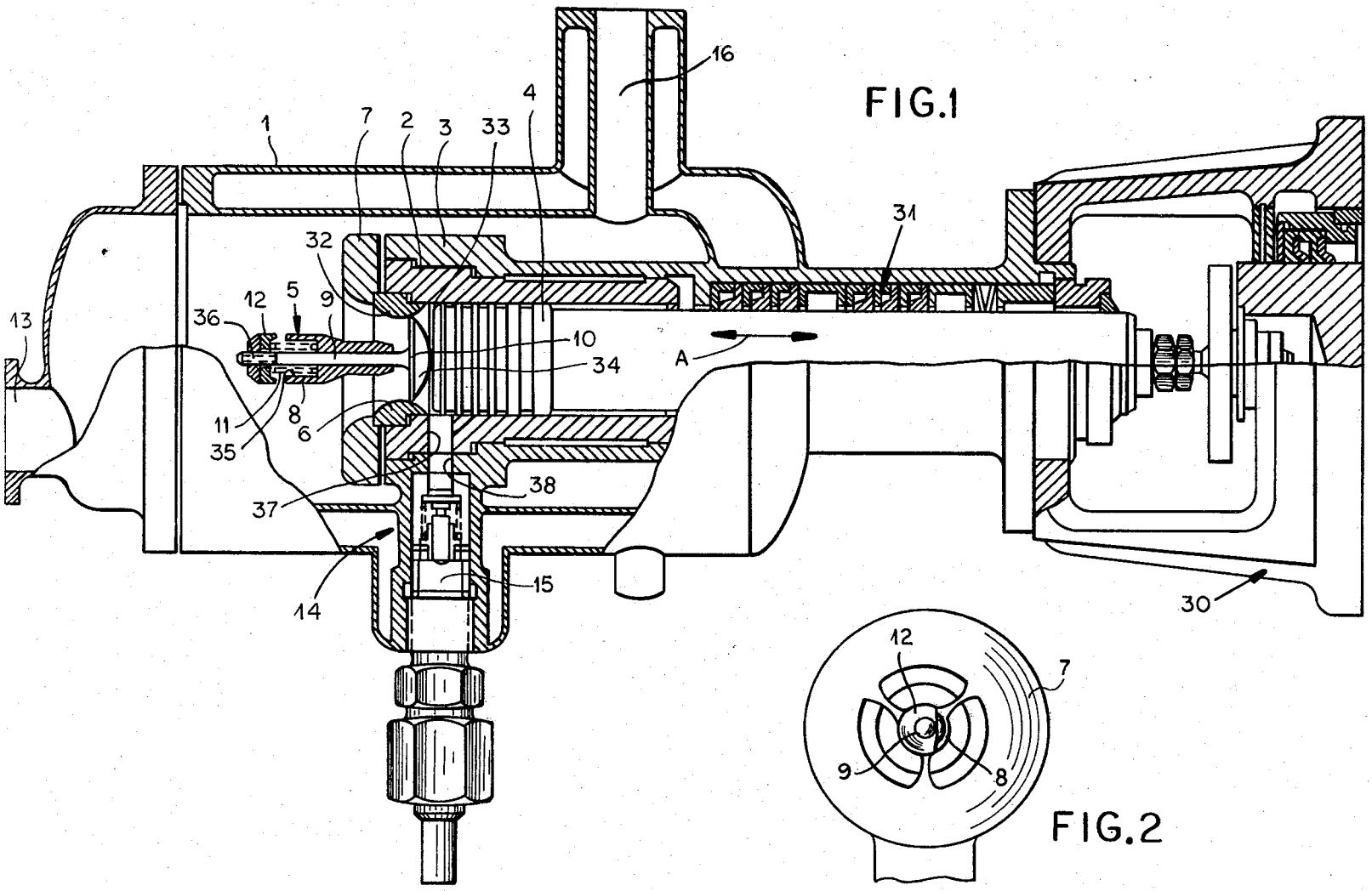
FIG. 1 is an elevational view, partly in axial section, of a piston pump according to the present invention.
FIG. 2 is an end view of the pump chamber.

In the drawing we have shown an axial piston pump for deeply cooled liquid gases and other cryogenic fluids although it should be understood that the system is equally operable for the pumping of other liquids.

A pump chamber in the form of a cylinder 2 is disposed in the double wall housing 1 which serves to prevent the incursion of heat, the wall of the housing 1 being evacuated and/or filled with superinsulation. This serves to minimize losses by evaporation in the pump.

The cylinder 2 is received in a cylinder housing 3 connected to the housing 1 and receiving a reciprocating piston 4 which is axially shiftable as represented by the arrow A in intake and discharge strokes respectively.

Any conventional drive means represented at 30 e.g. an electric motor, can be used for reciprocating the piston which is provided with seals 31 to prevent the escape of fluid there along.

At the axial end of the cylinder 2 which is approached by the piston 4 at the end of its discharge stroke and before the commencement of its intake stroke, an intake or suction valve 5 is provided. The valve 5 comprises a valve seat 6 which is fixed to the end of the cylinder 2 and defines an intake port 32 which opens into the pumping chamber 33. The seat 6 carries a valve ring 7 which is connected to the guide sleeve 8 (see FIG. 2) in which the stem 9 of a valve member is axially shiftable. At one end of this stem, there is formed the valve plate 10 which is provided with a covering of ferromagnetic material at 34, i.e. its face turned toward the piston 4.

The other diameter of the valve plate 10 is greater than in the diameter of the seat 6 so that this plate is drawn against the seat by a spring 11 which is received in a cylindrical recess 35 of the sleeve 8 and bears against a disk 12 so that, by rotating the disk 12, the force generated by the spring 11 in the valve-closing direction (to the left) can be adjusted.

The spring thus draws the valve member 10 into its closed position as shown.

The housing 1 is provided with an intake fitting 14 which can communicate with a source of the liquid gas.

The cylinder 12 has a radial discharge port 37 which communicates with a corresponding port 38 in the housing 3 and in which a pressure valve 14 is mounted upstream of the discharge fitting or the high pressure pump fluid.

The housing has a venting opening 16 for discharging evaporated liquid.

As indicated, the piston 4 is formed as a permanent magnet which magnetically attracts the ferromagnetic material 34 on the valve member 10 so that the magnetic force acts counter to the force of spring 11.

In use, the fitting 13 is connected to a supply vessel containing the cryogenic liquid which is generally displaceable at temperatures in the region of the boiling point so that the intake operation, which results in a reduction in pressure at the intake side, gives rise to some evaporation. For this reason it is desirable that the fluid to be displaced flow into the cylinder 2 at its container pressure or head, i.e. without substantial pressure drop. The supply vessel is thus usually located so that the liquid level therein is above the cylinder 2.

With the piston in the position shown, i.e. its closest approach to the valve member 10, the magnetic force exceeds the force of spring 11 so that as soon as the piston 4 begins its intake movement to the right, the valve member 10 is entrained therewith to open the intake port 32.

The disk 12 limits the maximum displacement of the spindle 9 to the right and liquid flows into the pumping member. When the piston 4 has reached the opposite end of its intake stroke (which may be a total of 45 mm in length) it is reversed, i.e. displaced to the left whereupon the spring 11 immediately closes the valve 10 since the magnetic force thereof is negligently small.

The piston 4 displaces the liquid in the cylinder 2 through the pressure valve 14 and the outlet 15.

Naturally with the system of the invention, one can reduce the head of liquid upstream of the intake port 32 to whatever level ensures that the magnetic force will hold the valve open against the spring force. There is thus no delay in opening of the valve 10 upon the commencement of an intake stroke.

We claim:

1. A piston pump comprising:

a cylinder;

a pumping piston member reciprocatable in said cylinder and having an intake stroke upon movement in one direction and a discharge stroke upon movement in the opposite direction;

an intake port formed in said cylinder and provided with an intake valve having an intake valve member approached by said piston at the end of a discharge stroke, and a spring biasing said valve member into a closed position, a discharge port provided with a discharge valve whereby fluid is displaced from said cylinder through said discharge port during said discharge stroke; and magnetic means providing a magnetic force between said intake valve member and said pumping piston member counter to the force of said spring only upon approach by said piston to said intake valve member at the end of a discharge stroke, thereby attracting said intake valve member to open said intake valve temporarily by the magnetic force upon the inception of the intake stroke.

2. The pump defined in claim 1 wherein one of said members is a permanent magnet and the other of said members is provided with ferromagnetic matter.

3. The pump defined in claim 2 wherein said piston member is formed with said permanent magnet.

4. The pump defined in claim 3 wherein said valve member is provided with a layer of the ferromagnetic material.

5. The pump defined in claim 1, claim 2, claim 3 or claim 4 wherein at the distance of closest approach of said piston member to said valve member the magnetic force there between is greater than the force of said spring.

* * * * *